US005855251A

United States Patent [19]

Deuer

[11] Patent Number: 5,855,251

[45] Date of Patent: Jan. 5, 1999

[54] SECURITY DEVICE FOR USE WITH A SAFETY LINE

[76] Inventor: Joseph F. Deuer, 560 W. David Rd., Kettering, Ohio 45429

[21] Appl. No.: 787,136

[22] Filed: Jan. 22, 1997

[51] Int. Cl.[6] ..... A62B 1/16

[52] U.S. Cl. ..... 182/5; 182/192; 188/65.2

[58] Field of Search ..... 188/65.1, 65.2; 182/4, 5, 6, 7, 133, 134, 135, 136, 191, 192, 193; 24/134 R, 136 R

[56] References Cited

U.S. PATENT DOCUMENTS

| | | | |
|---|---|---|---|
| 1,033,311 | 7/1912 | Gilloon et al. | 182/5 X |
| 1,457,029 | 5/1923 | Hazlett et al. | 24/136 R |
| 2,080,700 | 5/1937 | Dale | 24/134 |
| 2,638,618 | 5/1953 | Legge | 15/247 |
| 3,177,544 | 4/1965 | Murdock | 24/134 |
| 3,179,994 | 4/1965 | Meyer et al. | 24/134 |
| 3,317,971 | 5/1967 | Meyer | 24/134 |
| 3,492,702 | 2/1970 | Stafford | 182/5 X |
| 3,811,155 | 5/1974 | Stafford | 182/5 X |
| 3,852,943 | 12/1974 | Healy | 24/134 |
| 3,876,036 | 4/1975 | Sweet | 182/5 X |
| 3,979,797 | 9/1976 | Stember | 24/134 |
| 4,034,828 | 7/1977 | Rose et al. | 182/5 |
| 4,071,926 | 2/1978 | Sweet et al. | 24/136 |
| 4,077,094 | 3/1978 | Swager | 24/134 |
| 4,253,318 | 3/1981 | Gibbs | 24/134 |
| 4,542,884 | 9/1985 | Dodge, Jr. | 182/5 X |
| 4,560,029 | 12/1985 | Dalmaso | 182/5 |
| 4,912,817 | 4/1990 | Sandreid | 24/134 R X |
| 5,083,350 | 1/1992 | Sandreid | 24/134 R |
| 5,156,240 | 10/1992 | Ostrobrod | 188/65.1 |
| 5,265,696 | 11/1993 | Casebolt | 182/8 |
| 5,323,873 | 6/1994 | Pelofi | 182/192 X |
| 5,531,297 | 7/1996 | Pipan | 188/65.2 X |
| 5,638,919 | 6/1997 | Pejout | 182/5 X |

*Primary Examiner*—Daniel P. Stodola
*Assistant Examiner*—Richard M. Smith
*Attorney, Agent, or Firm*—Biebel & French

[57] ABSTRACT

A security device for detachably attaching a lanyard to a safety device. The device includes a main frame portion defining a U-shaped safety line channel for receiving a safety line, and a movable frame portion pivotally mounted to the main frame portion and carrying a cam portion for frictionally engaging the safety line. The cam portion is movable into engagement in response to a downward force from a lanyard attached to the movable frame portion. The cam portion is mounted on bushings aligned with apertures in the main frame portion and held in position by removable pin members. The pin members, in combination with the bushings provide a strong beam structure extending across the main frame portion to provide a rigid support structure for the cam portion for resisting deformation of the structure when a heavy load is applied. In addition, the pin members may be removed to allow the movable frame portion to pivot to an open position for allowing insertion and removal of the safety line to and from the security device.

14 Claims, 16 Drawing Sheets

SECURITY DEVICE FOR USE WITH A SAFETY LINE

BACKGROUND OF THE INVENTION

1. Field of the Invention

The present invention relates generally to security devices for use in combination with a safety line for preventing the fall of workers and, more particularly, to a security device formed of pivotally joined members held together by removable members which engage the device to provide a stable structure for supporting large loads.

2. Description of the Prior Art

Security devices are now commonly used by workers working in elevated positions, such as those employed on movable scaffolds. In order to prevent a worker from falling from a scaffold or work platform, a personal safety line is provided suspended from a position above the worker. The security device for attachment to the safety line is used in conjunction with a safety belt or harness fastened about the worker, and a lanyard is secured between the safety belt or harness and the security device. Typically, the lanyard is relatively short, and is provided with sufficient length to allow the worker some freedom of movement in the horizontal direction. In addition, the security device is generally freely movable up and down the safety line as the worker slowly moves up and down relative to the safety line. However, if the worker should suddenly fall, the lanyard will cause the security device to firmly grip the safety line and thereby prevent the worker from falling.

Security devices typically used include at least two separable parts whereby the security device may be opened to allow insertion and removal of the safety line. For example, U.S. Pat. Nos. 4,077,094, 4,560,029 and 5,156,240 all disclose security devices which may be opened to facilitate safety line insertion and removal. Unfortunately, as a result of providing devices having movable parts for securing the device about a safety line, the structural integrity of the device may suffer. For example, the hinged device disclosed in U.S. Pat. No. 4,560,029 may deform when it is used to stop the fall of a worker. Similarly, the device disclosed in U.S. Pat. No. 4,077,094 may be subject to similar problems in that this device discloses a pivoted member held in place on a U-shaped housing by a pin passing through one end of the pivoted member and through the U-shaped housing, and held in position at an opposite end of the pivoted member by a single pivot pin passing through one side of the housing and the pivoted member. In this structure the applied forces are carried by the pivoted member and are transmitted from the pivoted member to the U-shaped frame through the connecting pin members. Such an indirect transfer of forces through a security device is generally undesirable.

U.S. Pat. No. 5,156,240 also discloses a security device wherein a U-shaped housing is adapted to cooperate with a movable member of the device. This device has proven to be difficult to use in that in order to open the device, a pin must be removed and the movable member pivoted and moved longitudinally parallel to the axis of the safety line. Such a device may be difficult for a worker to manipulate quickly in order to efficiently attach the device to a safety line.

Accordingly, there is a need for a security device which may be attached to a safety line quickly and easily. In addition, there is a need for such a security device wherein the frame structure for the device is structurally configured to resist large deformation forces applied by a load hanging from the device.

SUMMARY OF THE INVENTION

The present invention provides a security device which may be readily attached to and removed from a safety line in order to connect a lanyard from a worker to the safety line.

The security device includes a frame assembly including a main frame portion and a movable frame portion mounted to the main frame portion for pivotal movement. The main frame portion comprises parallel first and second side plates and a U-shaped portion connecting the side plates. A safety line channel is located between the side plates adjacent to the U-shaped portion for receiving the safety line.

The movable frame portion comprises a pivot member which is attached to the first side plate at a pivot connection wherein the pivot connection defines a pivot axis extending perpendicular to the axis of the safety line channel. The movable frame portion supports a cam portion. The cam portion includes a cam member movable relative to the movable frame portion and including a cam surface directed into the channel for engaging the safety line. In addition, a ring portion is connected to the cam portion for attachment of a lanyard extending from a worker's safety belt or harness. The ring portion is located such that application of a downward force on the ring will cause the cam member to move into engagement with and grip the safety line.

The first and second side plates each include a first aperture wherein the first apertures are aligned along a first common axis parallel to the pivot axis. Similarly, a pair of second apertures are formed through the first and second side plates and aligned along a second common axis parallel to the pivot axis. A first pin passage is defined through the pivot member for receiving a first removable pin which also extends through the pair of first apertures. A second pin passage is also defmed through the pivot member for receiving a second removable pin extending through the second pin passage and the pair of second apertures. The first and second removable pin members hold the pivot member in a closed position relative to the main frame portion. In addition, the first and second pin passages are preferably defined by bushings for supporting the cam portion such that the pins are positioned to provide a strong structure capable of supporting large loads.

The pivot member is movable about the pivot axis from a closed position to an open position providing clearance between the cam portion and the side plates for passage of a safety line into and out of the channel. Thus, in addition to providing a structurally sound security device, the present invention provides easy attachment to and removal from a safety line.

Therefore, it is an object of the present invention to provide a security device which may be readily attached to and detached from a safety line.

It is a further object of the invention to provide such a security device wherein the device may be easily pivoted between open and closed positions.

It is yet another object of the present invention to provide such a security device wherein the structure of the device is such that a strong frame structure is provided when it is in its closed position.

Other objects and advantages of the invention will be apparent from the following description, the accompanying drawings and the appended claims.

DETAILED DESCRIPTION OF THE PREFERRED EMBODIMENT

Figure 1:
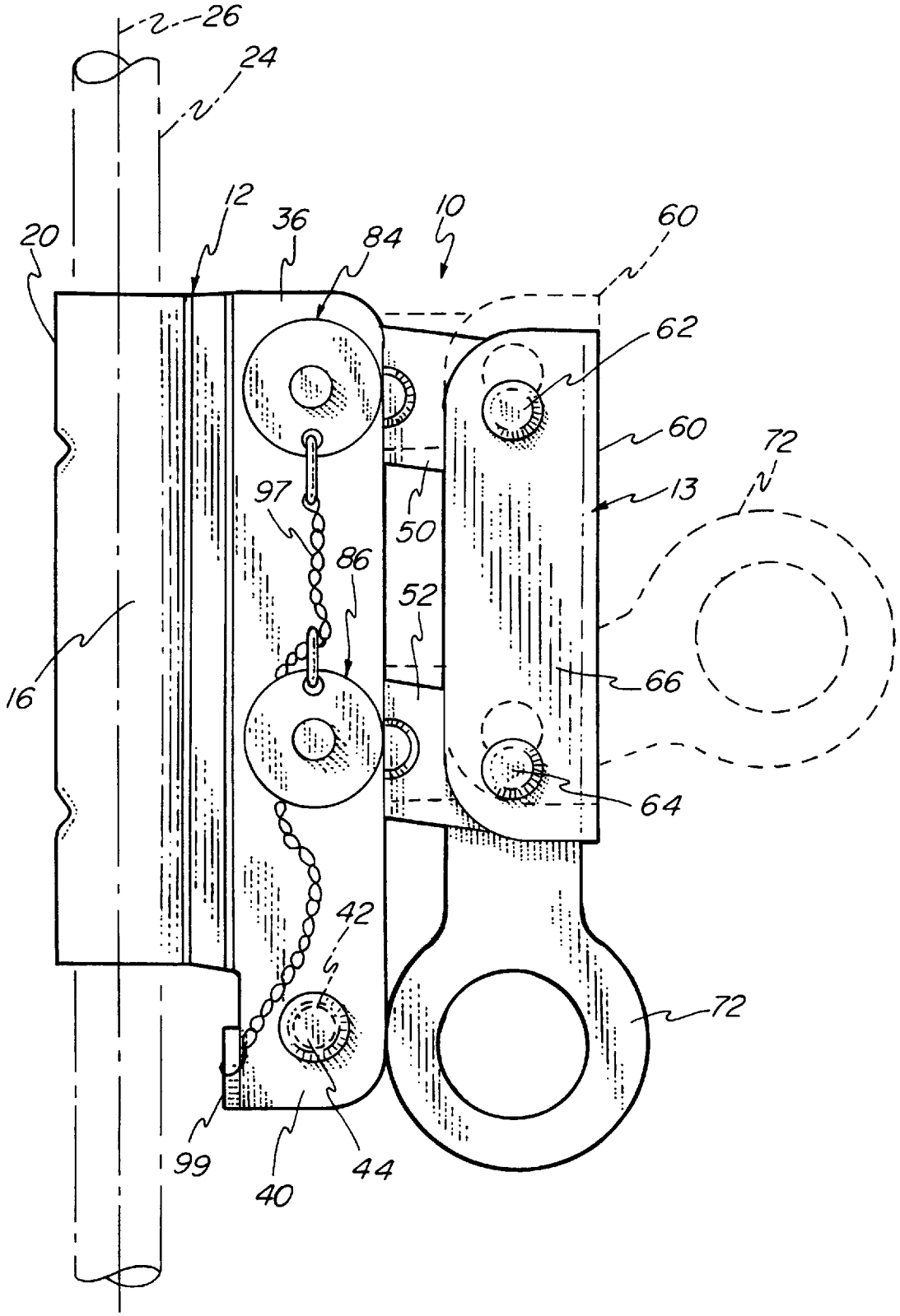
FIG. 1 is a front elevational view of the security device of the present invention.
Figure 2:
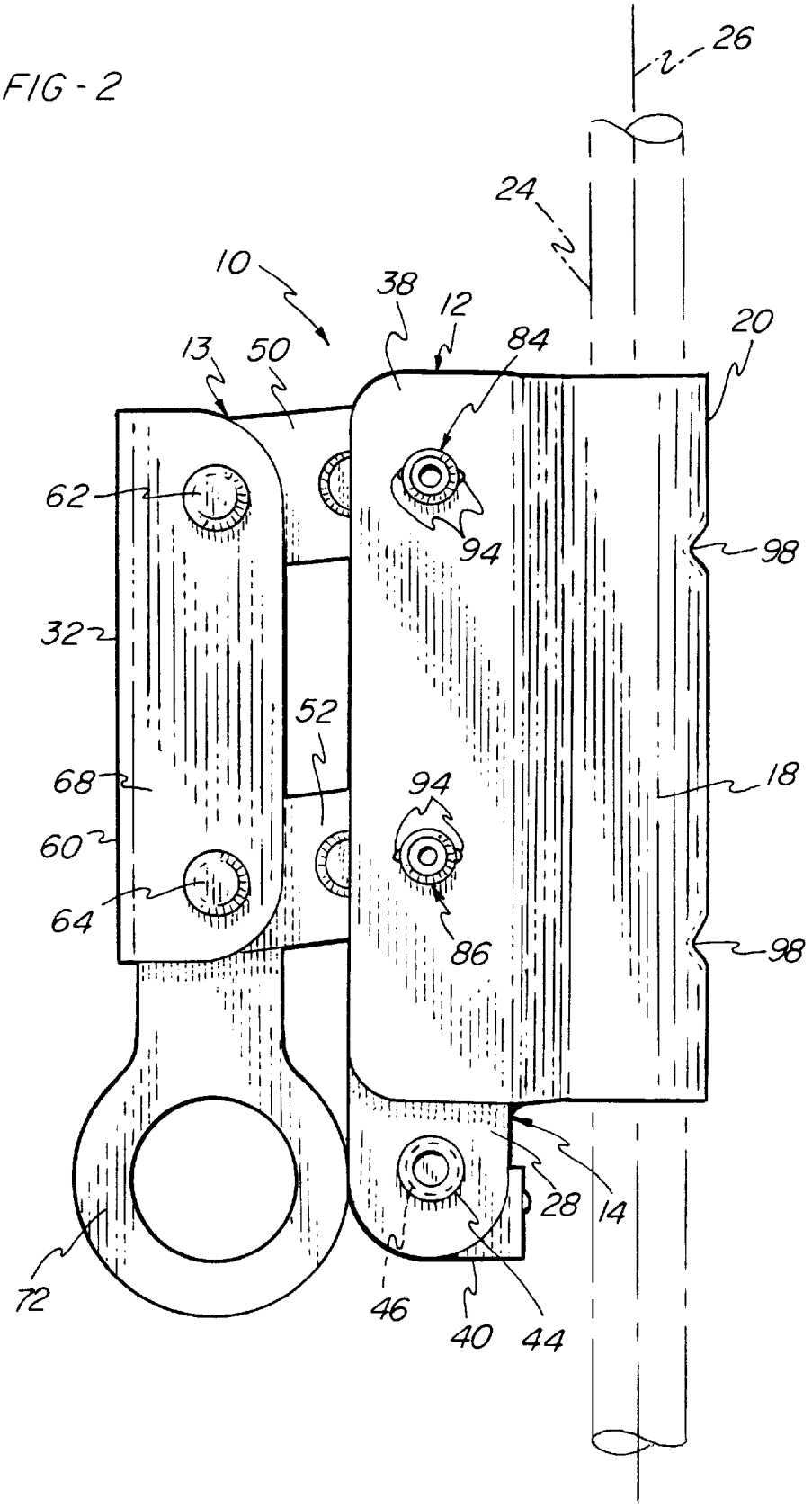
FIG. 2 is a rear elevational view thereof.
Figure 3:
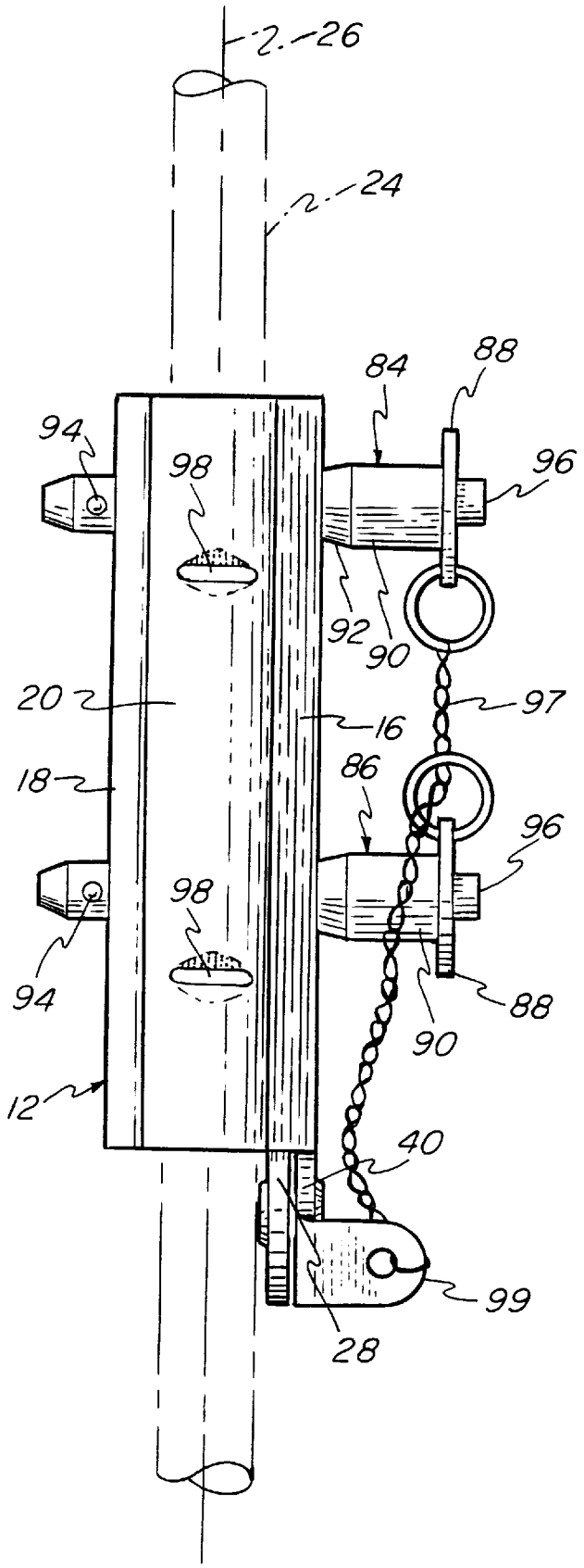
FIG. 3 is a left side elevational view thereof.

Referring to FIGS. 1–6, the security device of the present invention comprises a frame assembly 10 including a main frame portion 12 and a movable frame portion 13. The main frame portion 12 includes a first side plate 16, and a second side plate 18 parallel to the first side plate 16. The first and second side plates 16, 18 are joined by a U-shaped portion 20. A safety line channel 22 is located between the side plates 16, 18 and adjacent to the U-shaped portion 20 for receiving a safety line 24. The safety line channel 22 defines a channel axis 26 extending through the main frame portion 12.

Figure 7:
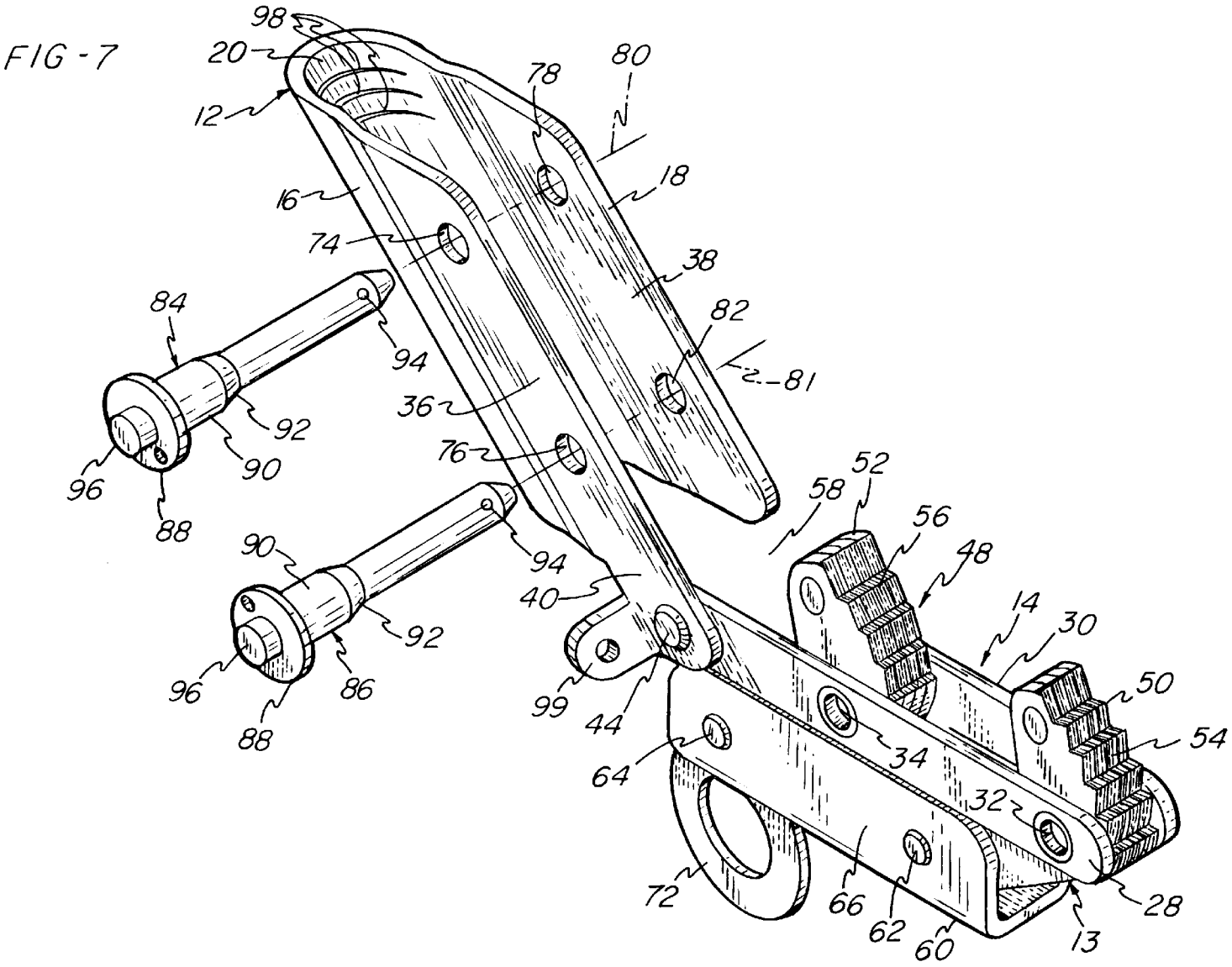
FIG. 7 is a perspective view of the security device in an open position.

As may be further seen in FIG. 7, the movable frame portion 13 comprises a pivot member 14 including parallel first and second pivot member plates 28 and 30 connected together by first and second bushings 32, 34 extending through the pivot member 14. The bushings 32, 34 maintain the pivot member plates 28, 30 at a spacing which is less than a spacing between outer portions 36, 38 of the first and second side plates 16, 18, respectively. Accordingly, the pivot member plates 28, 30 are adapted to be moved into a position between the first and second side plates 16, 18. In addition, the outer portion 36 of the first side plate 16 includes a longitudinally extending leg 40 defining an aperture 42 (FIG. 1) for receiving a fastener 44 therethrough. The fastener 44 passes through an aperture 46 (FIG. 2) in the first pivot member plate 28 whereby the pivot member 14 is mounted for pivotal movement relative to the main frame portion 12 about a predetermined pivot axis oriented perpendicular to the channel axis 26.

The pivot member 14 supports a cam portion 48 (FIG. 7) wherein the cam portion of the present embodiment comprises first and second cam members 50, 52 pivotally supported on the bushings 32, 34, respectively. The cam members 50, 52 each include serrated cam surfaces 54, 56 for engaging the safety line 24 when the security device is pivoted into a closed position with the pivot member 14 positioned between the side plates 16 and 18, and the cam surfaces 54, 56 directed into the channel 22. Further, in the open position of the security device shown in FIG. 7, a clearance space 58 is defined between the outer portion 38 of the side plate 18 and the cam surface 56 to permit a safety line to be inserted into and removed from the channel 22.

An end of the cam members 50, 52 opposite from the serrated surfaces 54, 56 is engaged by a U-shaped linkage member 60. The linkage member 60 includes pins 62, 64 extending between opposing walls 66, 68 of the linkage member 60 and passing through the ends of respective cam members 50, 52. The linkage member 60 extends parallel to the pivot member 14 such that the linkage member 60, pivot member 14 and cam members 50, 52 define a parallelogram structure for the movable frame portion 13. As can be seen in FIG. 1, the linkage member 60 is movable between a lower position, shown in solid lines, and an upper position, shown in phantom lines.

Figure 5:
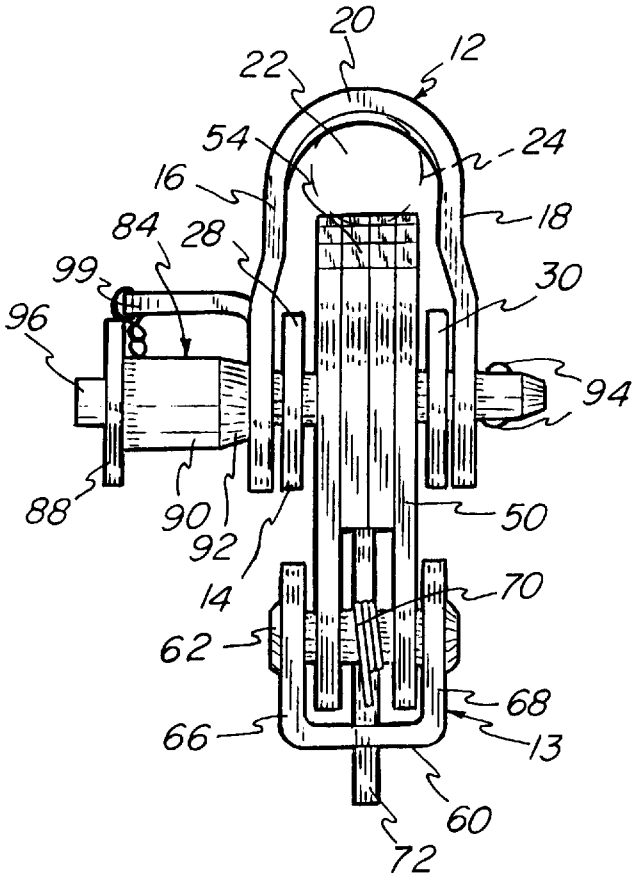
FIG. 5 is a top view thereof.

Referring to FIG. 5, it can be seen that a coil spring 70 may be provided extending around at least one of the pin members 62 and providing tension between the linkage 60 and the cam member 50 whereby the cam surfaces 54, 56 may be biased toward engagement with the safety line 24.

Figure 4:
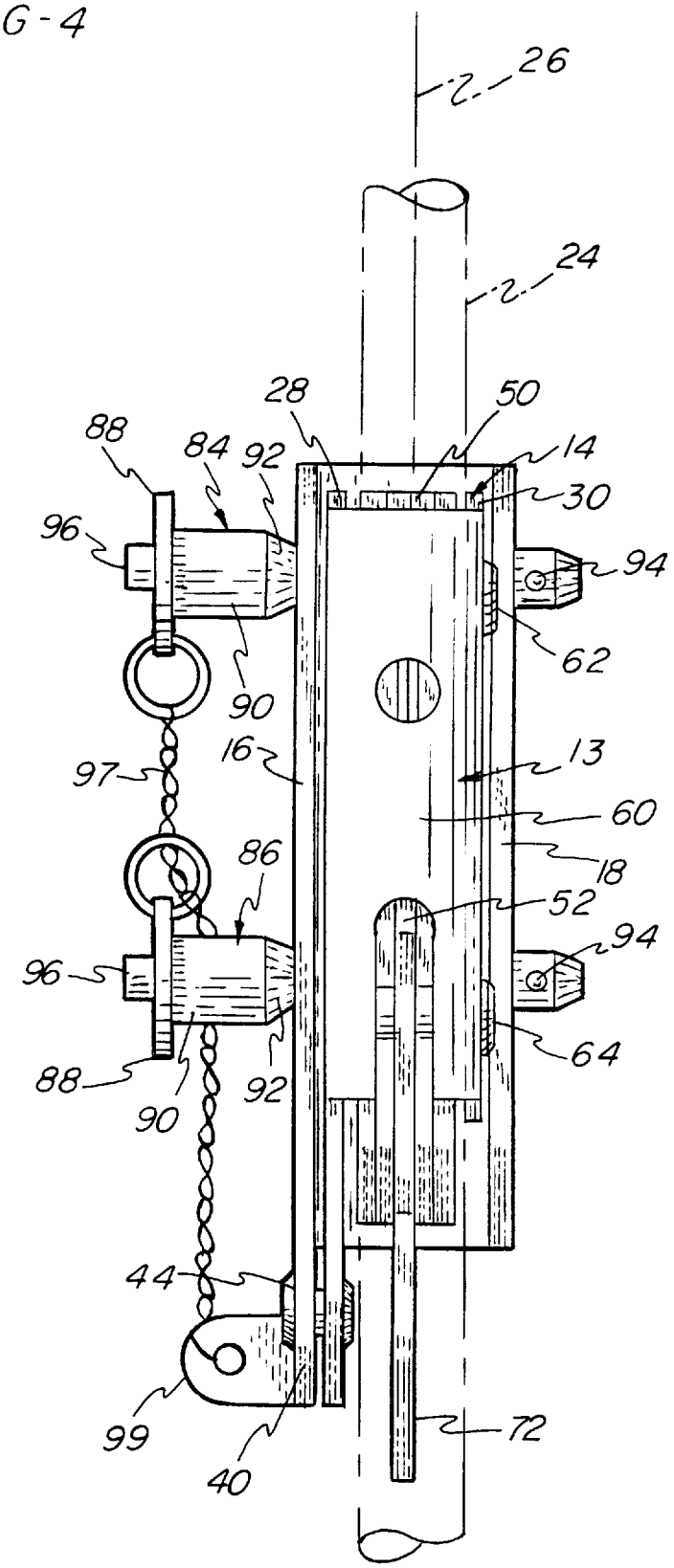
FIG. 4 is a right side elevational view thereof.
Figure 6:
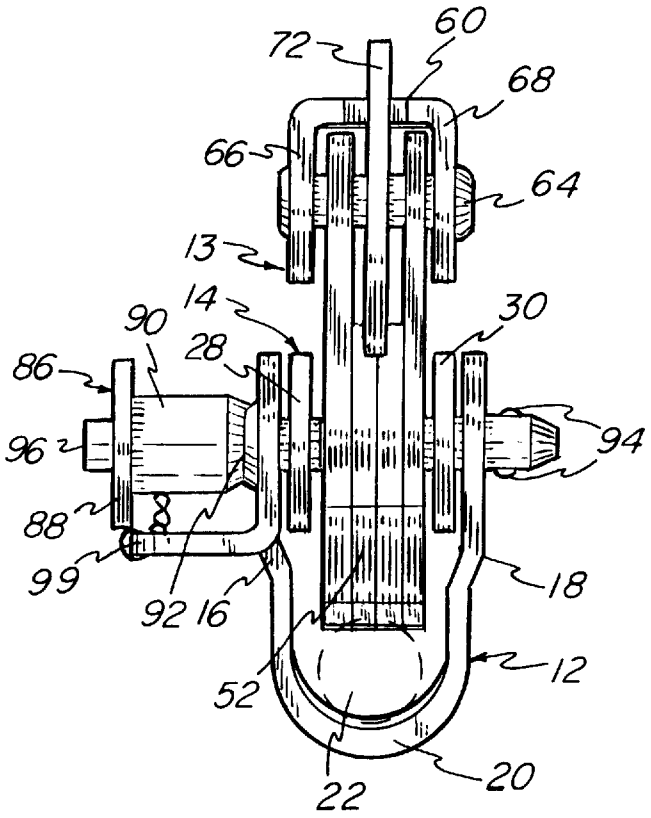
FIG. 6 is a bottom view thereof.

As seen in FIGS. 4 and 6, a ring portion 72 is also supported on the pin 64 and provides an attachment point for a worker's lanyard, attached to a safety belt or harness of a worker. The ring portion 72 may freely rotate with respect to the pin 64 and link member 60. For example, the ring portion 72 may move between the two positions illustrated in FIG. 1 in solid and phantom lines.

As seen in FIG. 7, the first side plate 16 of the main frame portion 12 includes a first aperture 74 and a second aperture 76. Similarly, the second side plate 18 includes a first aperture 78 aligned along a common axis 80 with the first aperture 74, and a second aperture 82 aligned along a common axis 81 with the second aperture 76. When the movable frame 13 is pivoted to a closed position with the main frame 12, the pair of first apertures 74, 80 are aligned with a pin passage extending through the first bushing 32, and the pair of second apertures 76, 82 are aligned with a pin passage extending through the second bushing 34.

A first locking pin 84 is positioned extending through the first apertures 74, 80 and through the passage in the first bushing 32, and a second locking pin 86 is positioned extending through the second apertures 76, 82 and through the passage through the second bushing 34. The locking pins 84, 86 are of a conventional type well known in the art and each includes a head 88 located adjacent to a barrel portion 90 having a stop portion 92 which limits the extent to which the pin may be inserted through the apertures 74, 76, 80, 82. The pins 84, 86 are held in a locked position by a spring loaded ball 94 located on the circumference of the pins 84, 86 adjacent to distal ends thereof. When the pins 84, 86 are located in the position shown in FIGS. 3 and 4, the distal end of the pins 84, 86 extend past the second side plate 18 and the ball 94 functions as a lock to prevent the pins 84, 86 from being withdrawn. When it is desired to remove the pins 84, 86, a button 96 in the head 88 may be depressed thereby allowing the ball 94 to move inwardly into the pins 84, 86. In addition, a chain 97 extends from a tab 99 on the leg 40 and is connected to each of the pins 84, 86 to prevent the pins 84, 86 from falling or otherwise becoming separated from the security device.

It should be noted that a particularly strong structure is provided by the present construction. Specifically, as may be best seen in FIGS. 8 and 9, the pins 84, 86 act in combination with the bushings 32, 34 to form two strong beam members extending across the width of the main frame portion 12 and aligned along a line parallel to the axis 26 of the channel 22 wherein each pin 84, 86 is positioned to act in double shear with one shear location at each end of the pins 84, 86 adjacent to the side plates 16, 18. In addition to this beam structure contributing to the rigidity acts as the frame portion 12, it further acts as the supports for the cam members 50 and 52 whereby the cam members 50, 52 are supported on a rigid support structure which resists deformation when heavy loads are applied to the security device.

Figure 8:
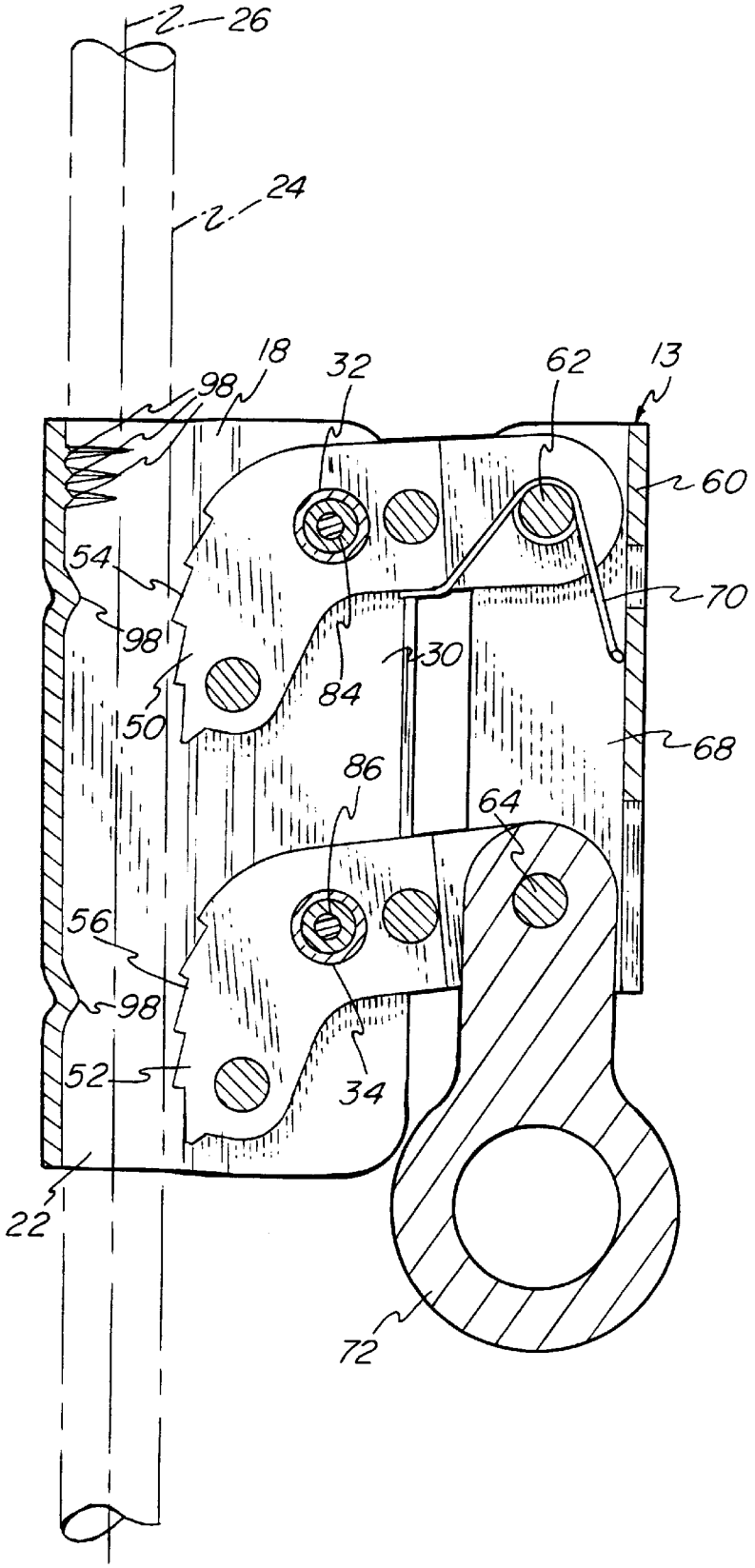
FIG. 8 is a sectional side elevational view of the device showing positioning of the cam portion for free movement of the device up and down a safety line.

The operation of the security device after attachment to a safety line is similar to the operation of the device disclosed in U.S. Pat. No. 4,560,029, which patent is incorporated herein by reference. As seen in FIG. 8, the cam members 50, 52 are positioned for normal upward and downward movement of the security device relative to the safety line 24. It should be noted that in this embodiment, the spring 70 is provided with a light enough tension to permit the security device to move upwardly and downwardly relative to the safety line 24 without catching, and provides sufficient tension to ensure that the cam members 50, 52 will readily engage the safety line 24 in the event that a downward force is applied to the ring portion 72.

Figure 9:
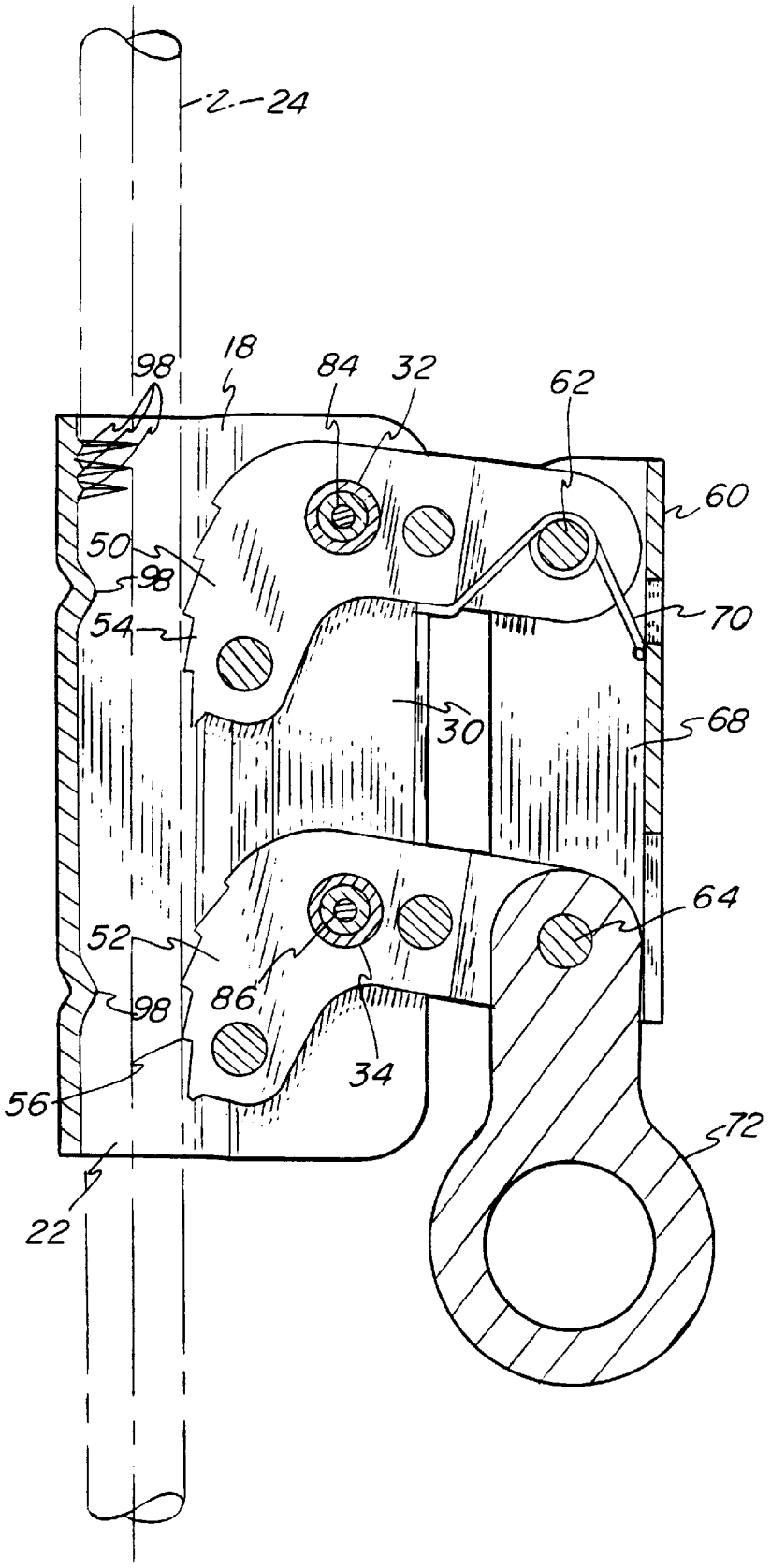
FIG. 9 is a sectional side elevational view of the device showing positioning of the cam portion when the weight of a person is supported on the device.
Figure 10:
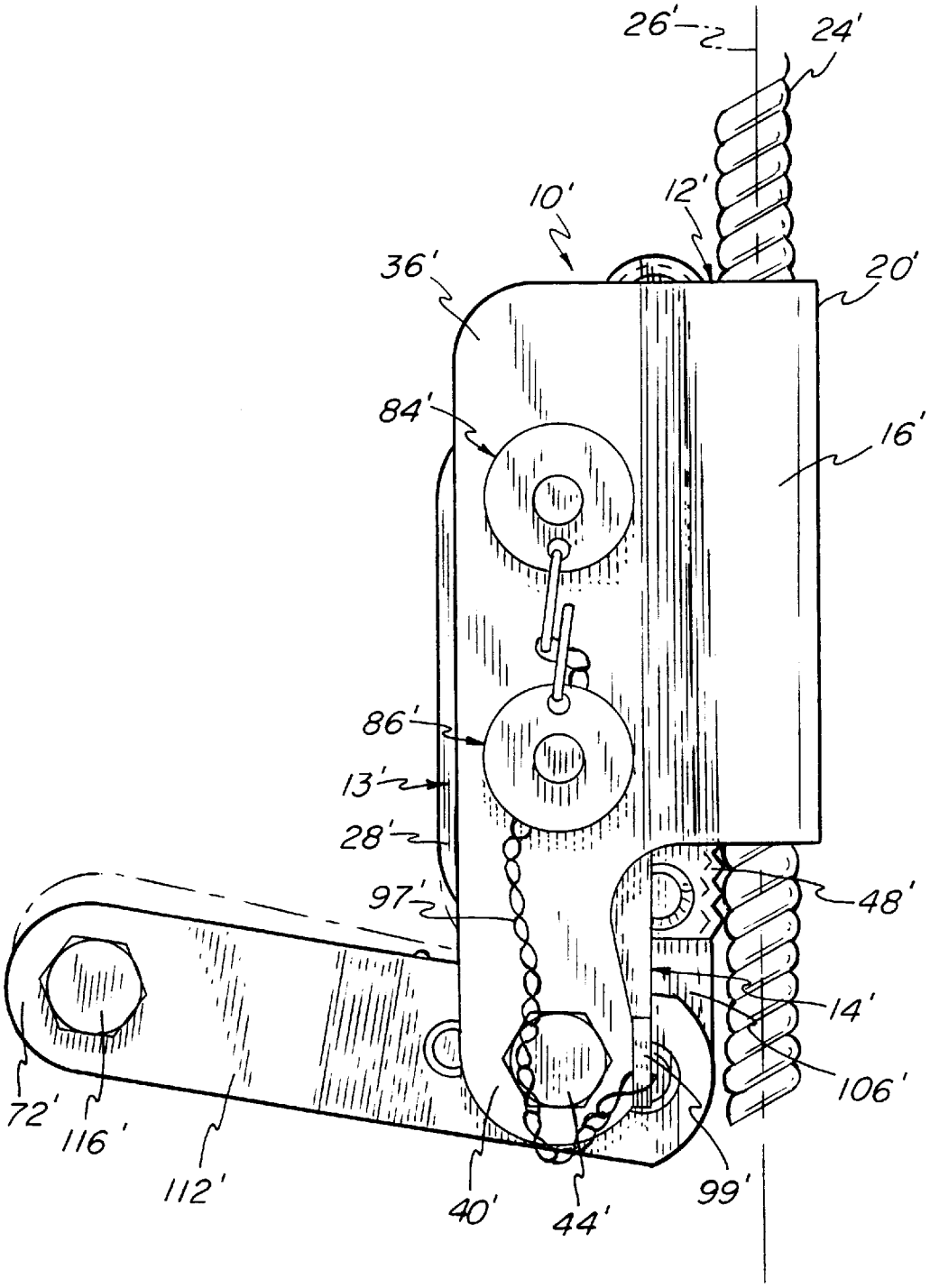
FIG. 10 is a front elevational view of a second embodiment of the security device of the present invention.
Figure 11:
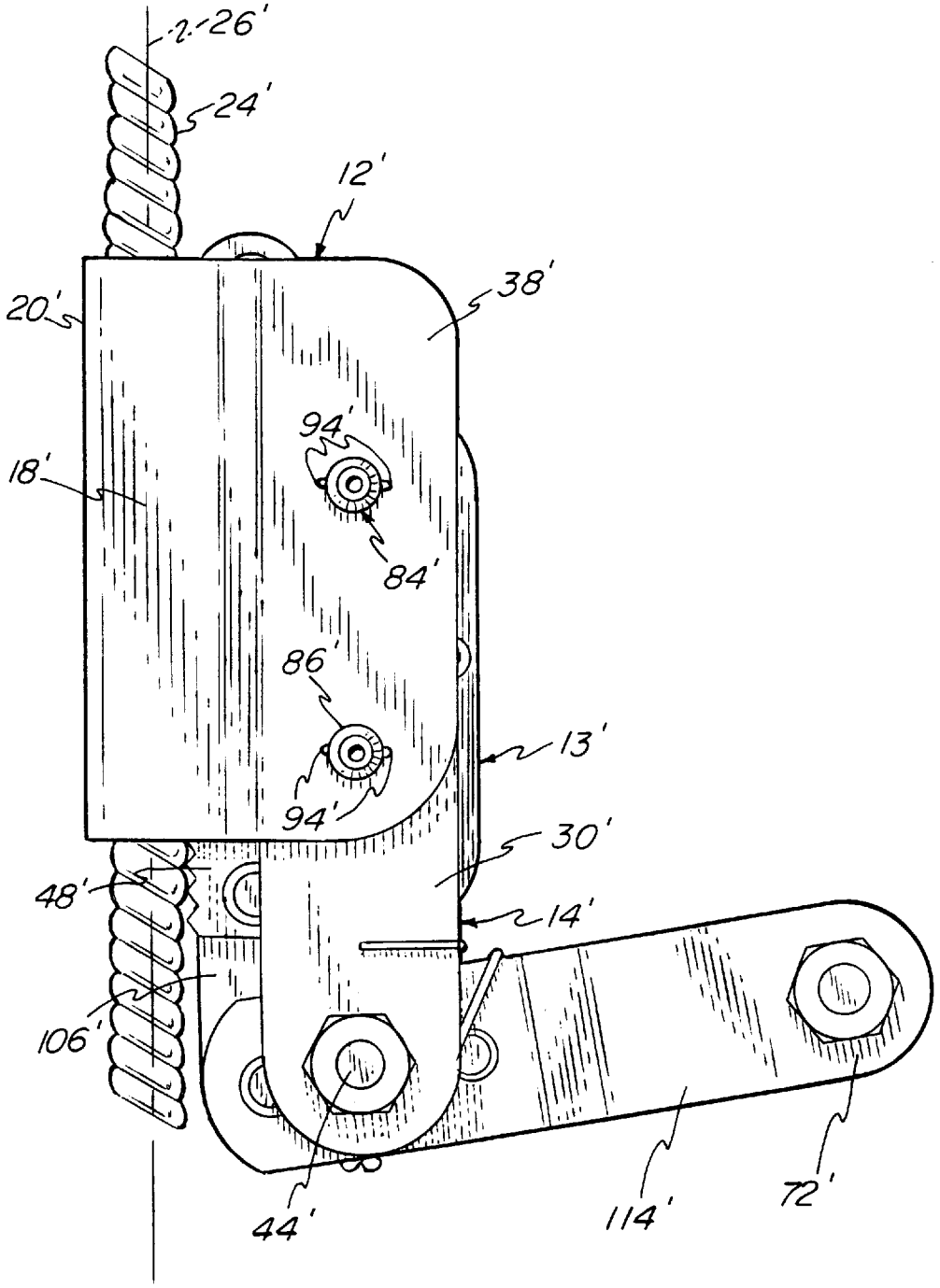
FIG. 11 is a rear elevational view thereof.
Figure 12:
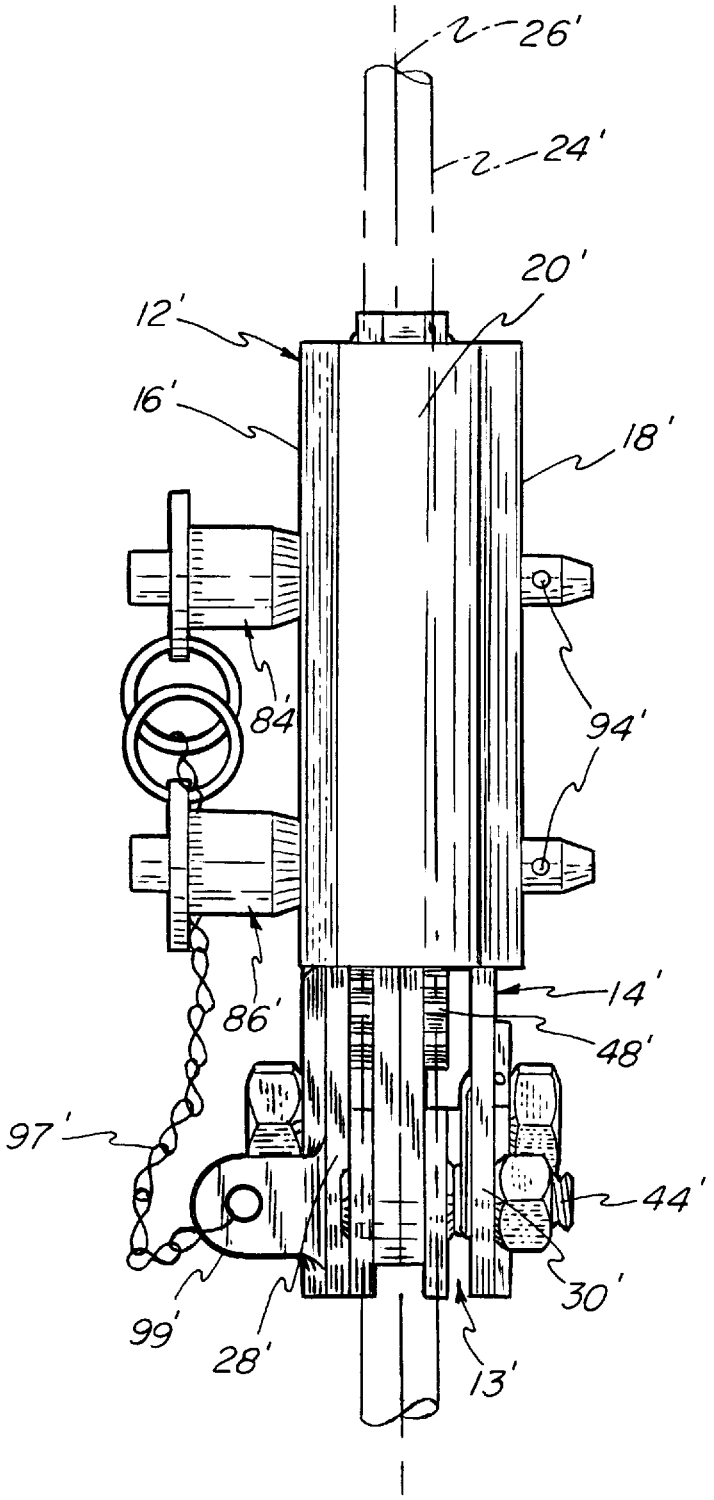
FIG. 12 is a right side elevational view thereof.
Figure 13:
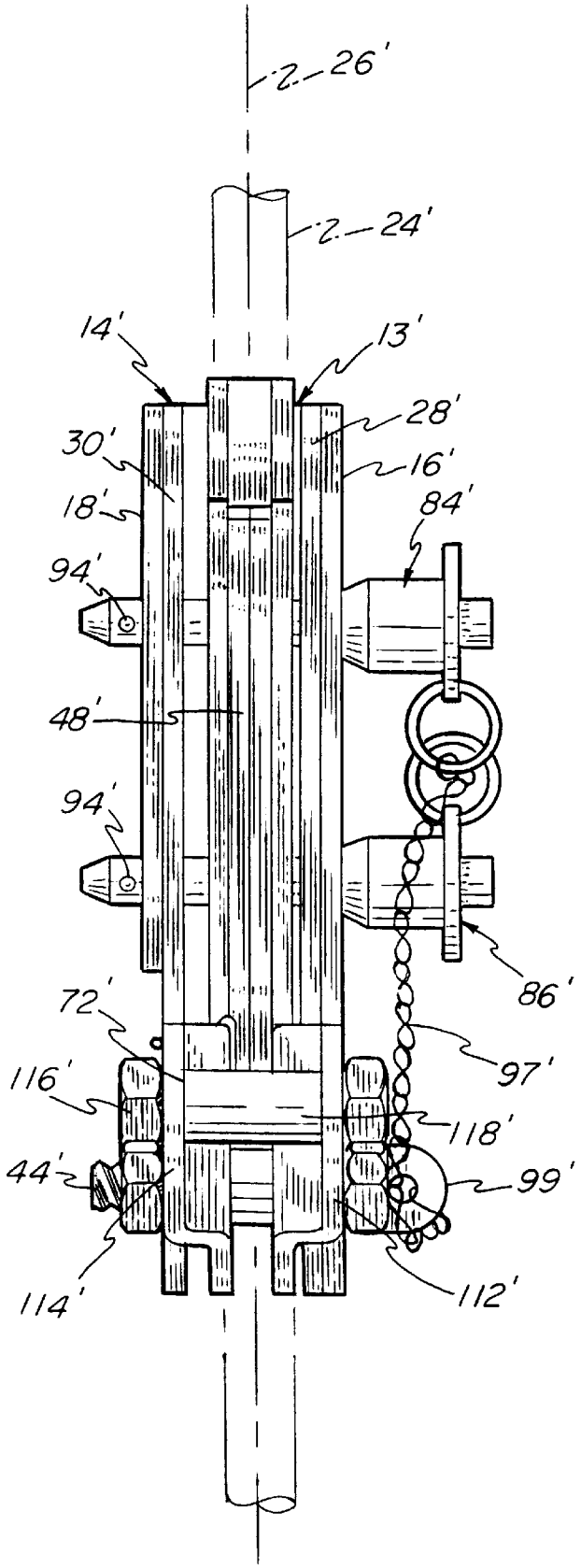
FIG. 13 is a left side elevational view thereof.
Figure 15:
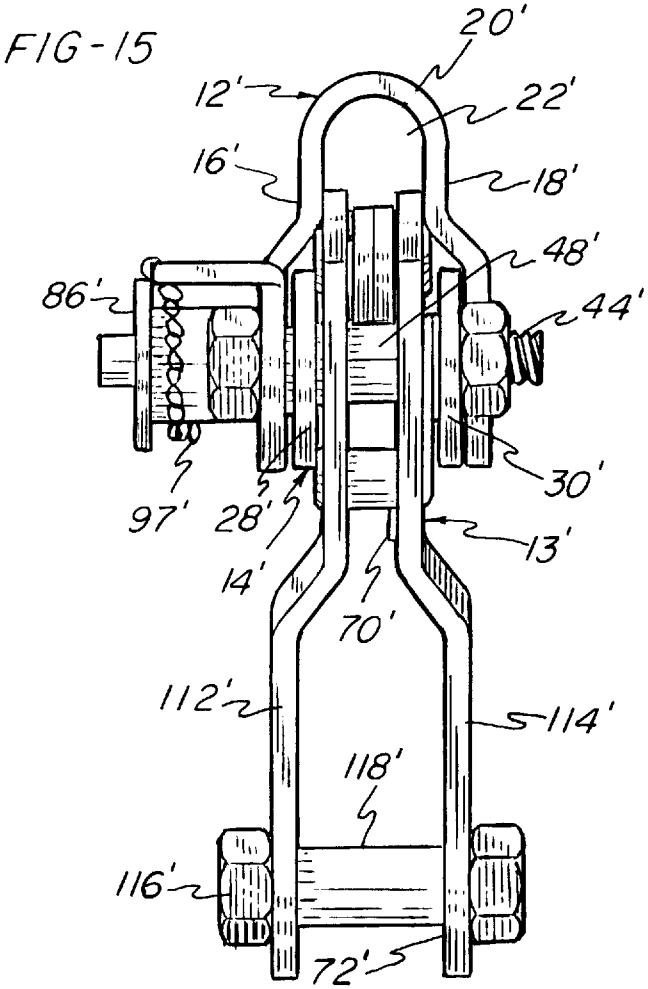
FIG. 15 is a bottom view thereof.
Figure 14:
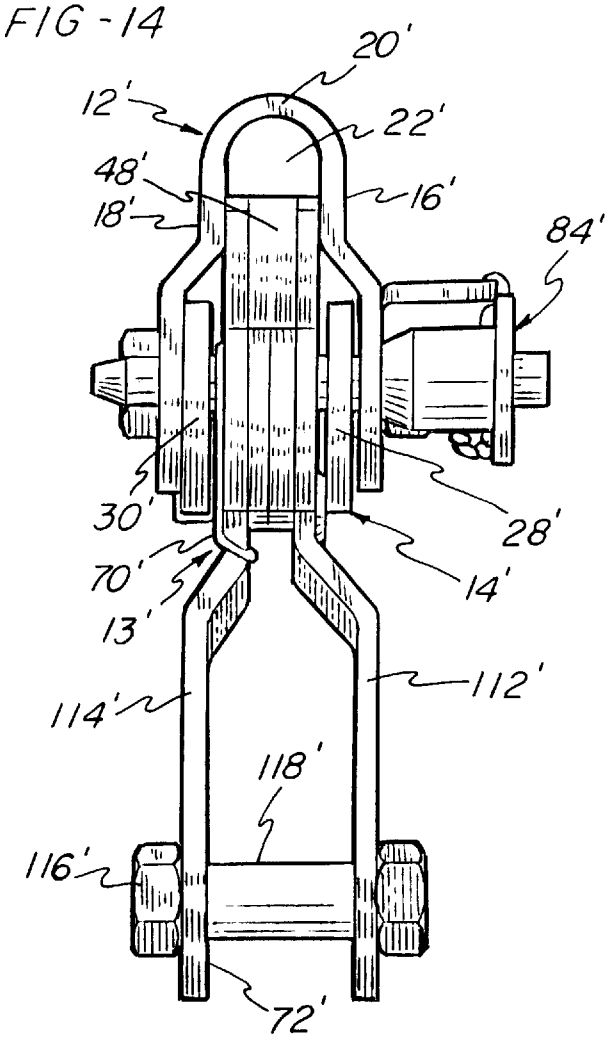
FIG. 14 is a top view thereof.
Figure 16:
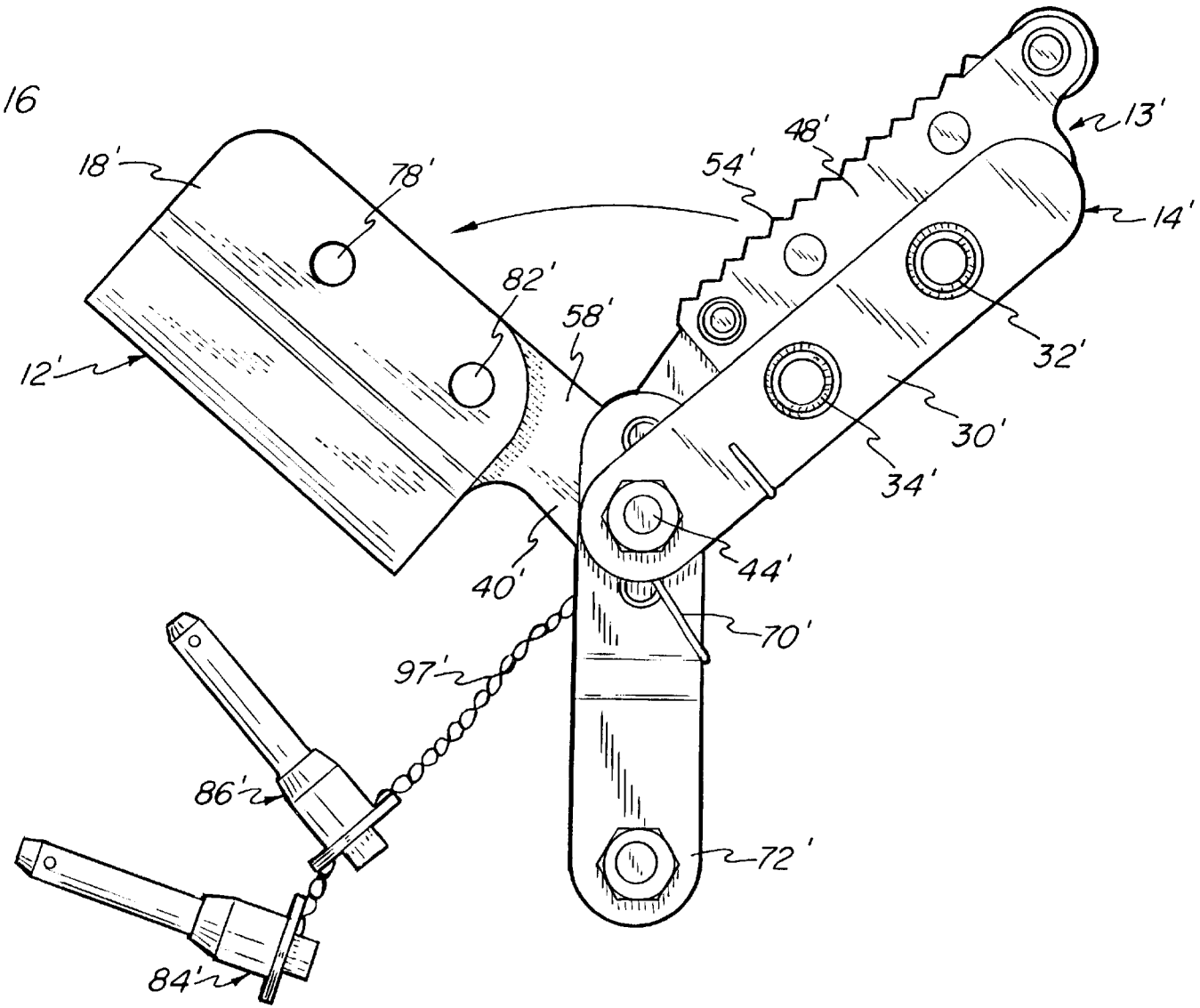
FIG. 16 is a side elevational view of the security device in an open position.
Figure 17:
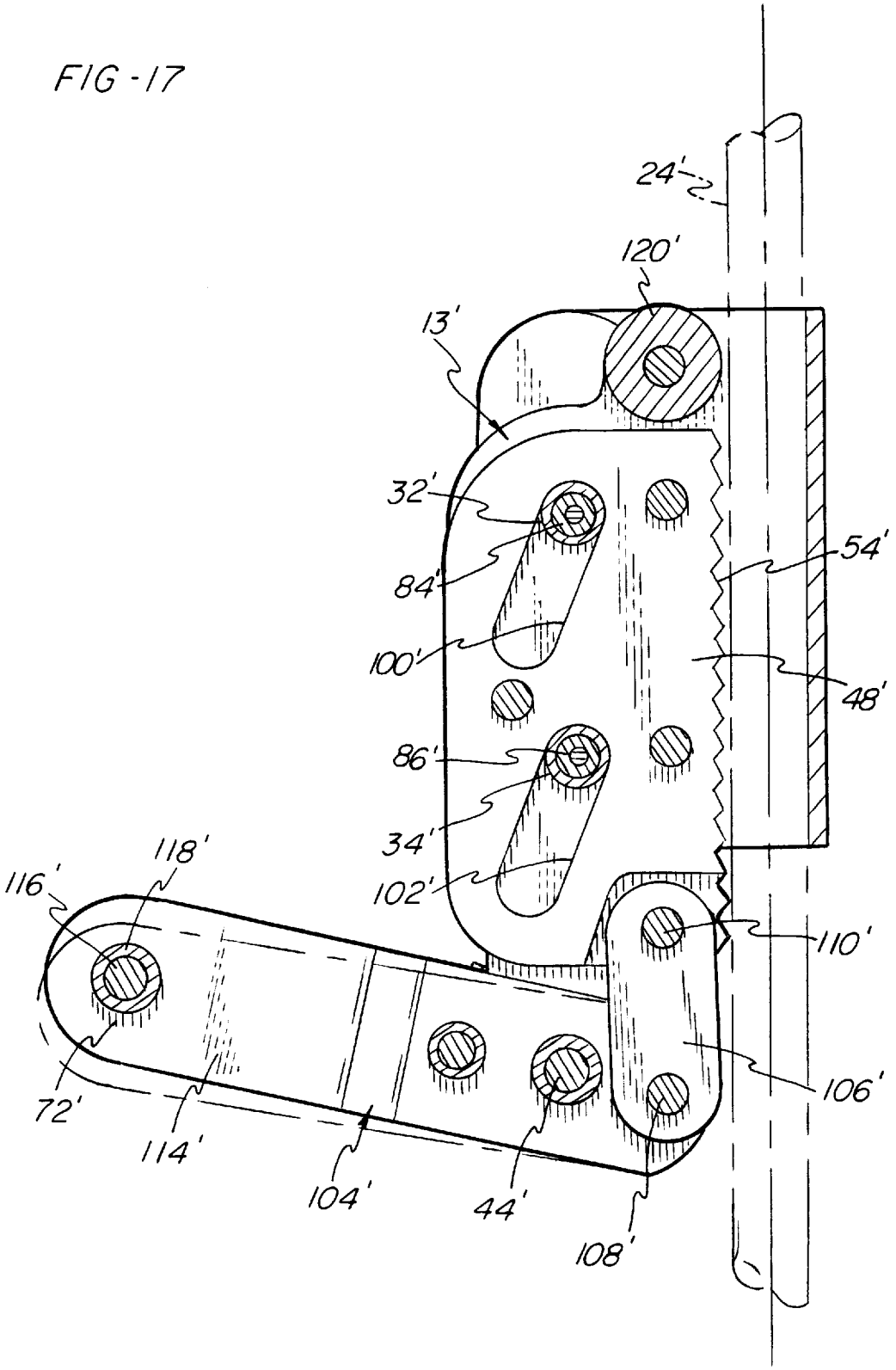
FIG. 17 is a sectional side elevational view of the device showing positioning of the cam portion for free movement of the device up and down a safety line.
Figure 18:
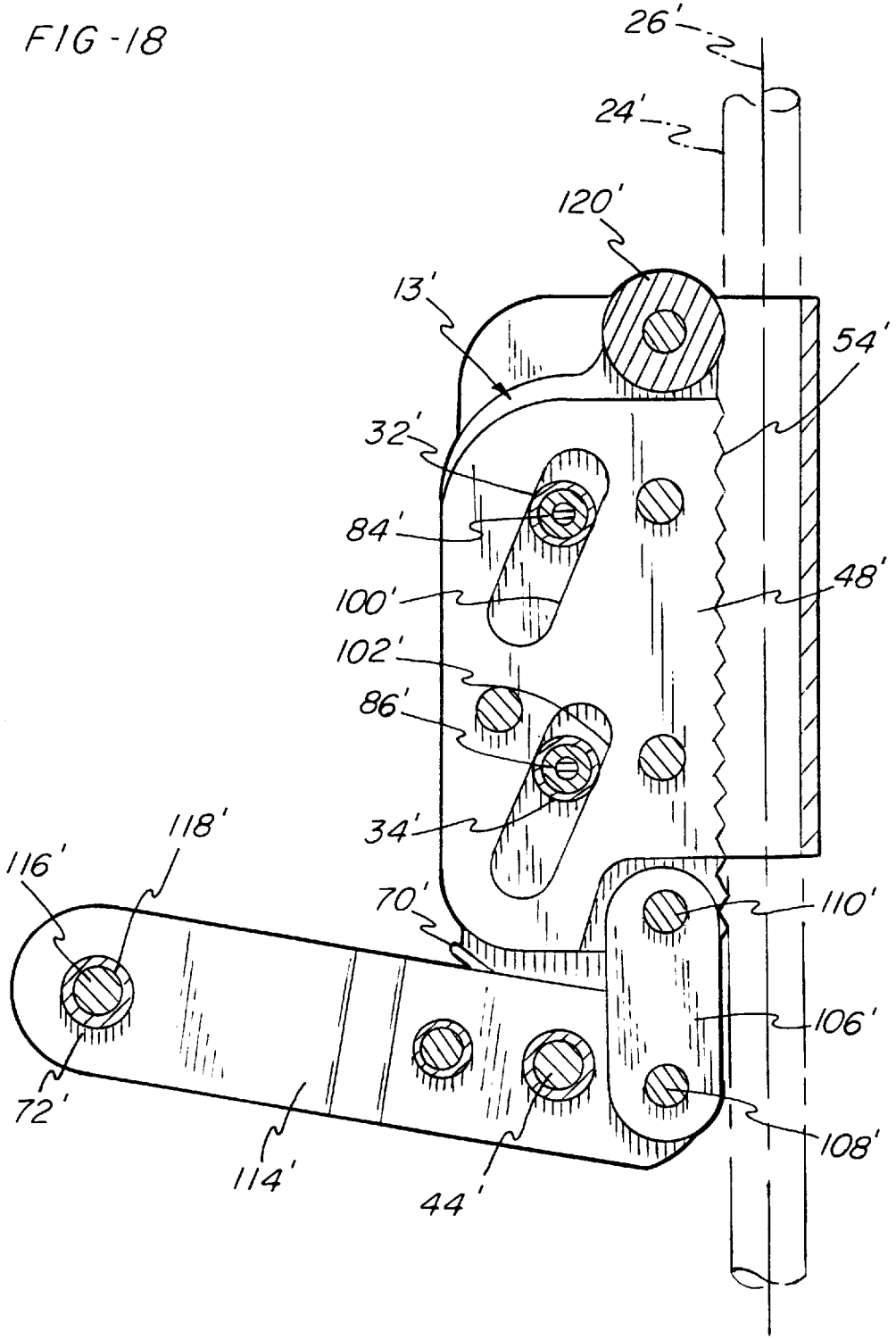
FIG. 18 is a sectional side elevational view of the device showing positioning of the cam portion when the weight of a person is supported on the device.

FIG. 9 illustrates the position of the cam members when a downward force is applied to the ring portion 72, such as in response to a downward force from a lanyard attached to a falling worker. In addition, it should be noted that the U-shaped portion 20 of the main frame portion 12 is formed with horizontal ribs 98 for facilitating frictional engagement between the frame assembly 10 of the security device and the safety line 24. The parallelogram structure formed between the pivot member 14, cam members 50, 52 and linkage members 60 ensures that the cam members 50, 52 move toward the safety line 24 simultaneously to apply substantially the same amount of pressure to the safety line 24 at two spaced locations along the frame assembly 10. Further, as previously noted, the beam-like supporting structure formed by the pins 84, 86 and bushings 32, 34 provide an exceptionally rigid structure whereby the axis of rotation for each of the cam members 50, 52 is held in substantially immovable relation to the U-shaped portion 20, and thereby further ensuring that the force applied by the cam members 50, 52 against the safety line 24 is substantially equal due to the frame assembly 10 not distorting in response to the application of a load thereto.

FIGS. 10–18 illustrate a further embodiment of the present invention. The present embodiment is structurally similar to the previous embodiment such that each of the elements of the present embodiment will not be specifically identified but may be identified through reference to the description of the previous embodiment.

Referring to FIGS. 10–16, it should be noted that the present embodiment provides substantially the same advantages as the previous embodiment, and differs only in the structure and function of the cam portion 48'. The present embodiment includes a main frame portion 12' and a movable frame portion 13'. The movable frame portion 13' comprises a pivot member 14' including parallel first and second pivot member plates 28' and 30' connected together by first and second bushings 32', 34' extending through the pivot member 14'. In addition, the movable frame portion 13' is connected at the pivot member 14' to a leg 40' by a fastener 44' whereby the movable frame portion 13' is attached for pivotal movement relative to the main frame portion 12'.

The main frame portion 12' includes parallel first and second side plates 16', 18' formed with aligned apertures for receiving the removable pin members 84', 86'. As in the previous embodiment, the movable frame portion 13' may be pivoted to move the cam portion 48' away from the main frame portion 12' in order to allow a safety line 24' to be inserted through a clearance space 58' into a channel 22' in the main frame portion 12'. Further, the pin members 84', 86', operate in combination with the bushings 32', 34' to form a rigid structure extending between the side plates 16', 18' whereby the security device forms a reinforced rigid structure resisting deformation.

The cam portion 48' of the present embodiment is particularly designed for use with a safety line 24' comprising a metal cable, and includes a serrated surface 54' extending substantially the entire length of the cam portion 48'. The cam portion 48' is supported on the movable frame portion 13' by the bushings 32', 34' wherein the cam portion 48' spans between the bushings 32', 34', and the bushings 32', 34' extend through elongated slots 100', 102' (FIGS. 17 and 18) formed in the cam portion 48'. The slots 100', 102' extend at an acute angle relative to the axis 26' of the channel 22'. The cam portion 48' is movable vertically relative to first and second pivot member plates 28', 30' of the pivot member 14'. As may be seen in comparing FIGS. 17 and 18, the surface 54' of the pivot member 14' moves into engagement with the safety line 24' as the cam portion 48' moves vertically upwardly within the security device.

An actuating lever 104' is supported for pivotal movement relative to the main frame portion 12' and movable frame portion 13' at the pivot axis defmed by the fastener 44'. The end of a connector member 106' is pivotally connected to a proximal end of the actuating lever 104' at a pivot point 108', and an opposing end of the connecting member 106' is pivotally connected to the cam portion 48' at pivot point 110'. A distal end of the actuating lever comprises spaced yoke plates 112', 114' and a fastener 116' and bushing 118' extending between the yoke plates 112', 114' to form a ring portion 72' for receiving a lanyard. Thus, when a lanyard attached to the ring portion 72' exerts a downward force on the distal end of the actuating lever 104', the connecting member 106' is displaced upwardly to move the cam portion 48' upwardly and toward the safety line 24', and thus lock the security device in place on the safety line 24'.

In addition, it should be noted that the cam portion 48' carries a roller 120' at an upper end thereof. The roller is adapted to contact and guide the security device along the safety line 24' when the cam portion 48' is in the position shown in FIG. 17 in order to prevent the cam surface 54' from snagging on the safety line 24', and thereby facilitate movement of the security device upwardly and downwardly relative to the safety line 24' when the device is not supporting a load from the ring portion 72'.

Further, a spring 70' is provided for exerting a light biasing force for biasing the distal end of the actuating lever 104' downwardly and thereby moving the cam portion 48' upwardly. The biasing force of the spring 70' is selected such that it ensures that the cam portion 48' is biased to a position adjacent to the safety line 24' while permitting upward and downward movement of the security device relative to the safety line 24' without catching on the safety line 24'.

Accordingly, it may be seen that the present embodiment incorporates the same advantages as the previous embodiment in that the security device includes a movable frame portion which may be pivoted about a fixed axis to open a main frame portion for receipt of a safety line. Further, the movable frame portion may be pivoted to a closed position and held in place by two removable pin members extending through bushings, the pin members and bushings forming transverse beam structures, each beam structure carrying a shear load at either end thereof and thereby providing a uniform distribution of forces through the device.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A security device for attaching a lanyard to a safety line, said device comprising:

a frame assembly including a main frame portion and a movable frame portion movably mounted to said main frame portion;

said main frame portion comprising parallel first and second side plates and a U-shaped portion connecting said side plates;

a safety line channel located between said side plates and adjacent to said U-shaped portion for receiving a safety line, said safety line channel defining a channel axis extending through said main frame portion;

said movable frame portion comprising a pivot member attached to said first side plate at a pivot connection, said pivot connection comprising a pivot aperture formed through each of said first side plate and said pivot member wherein said pivot aperture in said first side plate and said pivot aperture in said pivot member define a common, colinear axis on said main frame portion, and said pivot connection further including a rigid, elongated fastener affixed to said main frame portion and extending through both said aperture in said first side plate and said aperture in said pivot member to define a pivot axis extending perpendicular to said channel axis;

a cam portion supported on said movable frame portion, said cam portion comprising a cam member having a cam surface directed into said channel;

a ring portion connected to said cam portion for connection of a lanyard thereto;

a pair of first apertures formed through said first and second side plates and aligned along a first common axis parallel to said pivot axis;

a pair of second apertures formed through said first and second side plates and aligned along a second common axis parallel to said pivot axis;

first and second pin passages defined through said pivot member;

a first longitudinally removable pin member extending through said pair of first apertures and through said first pin passage, said first removable pin member supported for sliding movement within said first pin passage in a direction parallel to said pivot axis; and a second longitudinally removable pin member extending through said pair of second apertures and through said second pin passage, said second removable pin member supported for sliding movement within said second pin passage in a direction parallel to said pivot axis.

2. The device of claim 1 wherein said pivot member is pivotally movable about said pivot axis from a closed position with said cam portion located between said side plates to an open position providing clearance between said cam portion and said side plates for passage of a safety line into and out of said channel.

3. The device of claim 1 wherein said pivot member includes a pair of parallel pivot member plates connected together at said first and second pin passages by first and second bushings, respectively, and said cam portion is supported between said parallel plates.

4. The device of claim 3 wherein said cam portion comprises a pair of cam members, each said cam member supported on a respective one of said bushings.

5. The device of claim 4 including a linkage portion connected to each of said cam members, said linkage portion extending between said cam members to connect said cam members for simultaneous pivotal movement about said bushings.

6. The device of claim 5 wherein said linkage portion extends parallel to said pivot member such that said linkage portion, pivot member and cam members form a parallelogram structure.

7. The device of claim 3 wherein said cam portion comprises a plate including first and second elongated slots spaced from each other in the direction of said channel axis, and said first and second bushings extend through said first and second slots, respectively.

8. The device of claim 7 wherein said first and second slots extend at an acute angle relative to said channel axis.

9. A security device for attaching a lanyard to a safety line, said device comprising:

a frame assembly including a main frame portion and a movable frame portion comprising a pivot member pivotally mounted to said main frame portion;

said main frame portion comprising parallel first and second side plates and a U-shaped portion connecting said side plates, said first side plate having a pivot aperture;

a safety line channel located between said side plates and adjacent to said U-shaped portion for receiving a safety line, said safety line channel defining a channel axis extending through said main frame portion;

said pivot member including parallel pivot member plates and including a pivot aperture formed in one of said pivot member plates, said pivot member plate pivot aperture aligned with said pivot aperture in said first side plate, such that said pivot member plate pivot aperture and said pivot aperture in said first side plate define a common, colinear axis on said main frame portion;

a rigid, elongated fastener member extending through both said pivot member plate pivot aperture and said pivot aperture in said first side plate and extending along said common, colinear axis to define a pivot axis extending perpendicular to said channel axis;

a cam portion supported on said movable frame portion, said cam portion comprising a cam member having a cam surface directed into said channel;

a ring portion connected to said cam portion for connection of a lanyard thereto;

a pair of first apertures formed through said first and second side plates and aligned along a first common axis parallel to said pivot axis;

a pair of second apertures formed through said first and second side plates and aligned along a second common axis parallel to said pivot axis;

first and second pin passages defined by respective first and second bushings extending through said pivot member and connected to said parallel pivot member plates;

a first longitudinally removable pin member extending through said pair of first apertures and through said first pin passage, said first removable pin member supported for sliding movement within said first pin passage in a direction parallel to said pivot axis;

a second longitudinally removable pin member extending through said pair of second apertures and through said second pin passage, said second removable pin member supported for sliding movement within said second pin passage in a direction parallel to said pivot axis; and wherein said pivot member is pivotally movable about said pivot axis from a closed position with said cam portion located between said side plates to an open position providing clearance between said cam portion and said side plates for passage of a safety line into and out of said channel.

10. The device of claim 9 wherein said cam portion comprises a pair of cam members, each said cam member supported on a respective one of said bushings.

11. The device of claim 10 including a linkage portion connected to each of said cam members, said linkage portion extending between said cam members to connect said cam members for simultaneous pivotal movement about said bushings.

12. The device of claim 11 wherein said linkage portion extends parallel to said pivot member such that said linkage portion, pivot member and cam members form a parallelogram structure.

13. The device of claim 9 wherein said cam portion comprises a plate structure including first and second elongated slots spaced from each other in the direction of said channel axis, and said first and second bushings extend through said first and second slots, respectively.

14. The device of claim 13 wherein said first and second slots extend at an acute angle relative to said channel axis.

* * * * *